US005135234A

United States Patent [19]

Finch

[11] Patent Number: 5,135,234

[45] Date of Patent: Aug. 4, 1992

[54] COMPETITIVE HOME GAME AND METHOD FOR PLAYING SAME

[76] Inventor: Kenneth B. Finch, 1919 E. Carmen St., Tempe, Ariz. 85283

[21] Appl. No.: 673,644

[22] Filed: Mar. 22, 1991

[51] Int. Cl.[5] ..... A63F 9/18

[52] U.S. Cl. ..... 273/430

[58] Field of Search ..... 273/429, 430, 431, 432, 273/299, 300, 302, 272, 273

[56] References Cited

U.S. PATENT DOCUMENTS 4,586,707 5/1986 McNeight ..... 273/430
4,927,147 5/1990 Delzio ..... 273/146
4,932,667 6/1990 Gorski et al. ..... 273/249
4,964,642 10/1990 Kamille ..... 273/153 R X

*Primary Examiner*—William H. Grieb
*Attorney, Agent, or Firm*—David G. Rosenbaum

[57] ABSTRACT

A game played for entertainment or educational purposes in which a series of clues are revealed to the contestants one at a time, and from these clues, the contestants attempt to correctly guess a predetermined answer associated with a given series of clues. One person serves to control the play of the game and directs the contestants to apply certain specified cognitive skills to the identified clues to assist them in reaching the predetermined answer. The first contestant to identify the correct answer wins the round. The game may be played in multiple rounds with different systems to determine the winner of the game. The invention includes the method of playing the described game.

13 Claims, 2 Drawing Sheets

COMPETITIVE HOME GAME AND METHOD FOR PLAYING SAME

BACKGROUND OF THE INVENTION

This invention relates to the field of competitive games which can be played in the home or educational environment, specifically, guessing games involving reasoning, logic and other thinking skills to identify a specified answer which is associated with a series of clues.

There are many types of well-known competitive games that are played for entertainment purposes. "Charades", and games of a similar type, are well-known and are played having a person act out certain predetermined well-known quotes or phrases. The winner is the first contestant to correctly determine the quote or phrase being acted out. In the game of "Charades" the actor is required to act out his role silently. Many variations of this type of game are also well known, as shown by U.S. Pat. No. 4,932,667 issued to Gorski, et al., and U.S. Pat. No. 4,927,147 issued to Delzio.

Another class of well-known games are variations of "Charades" in which pictures are drawn to give hints to predetermined answers, which are well-known words and phrases, such as in the game "Pictionary". Games of this type are disclosed by U.S. Pat. No. 4,927,147 issued to Delzio.

Another type of game in this field of art is disclosed by U.S. Pat. No. 4,586,707 issued to McNeight, et al. This game uses a series of questions which are asked to the contestants, the answers to which are combined by some type of known or discoverable algorithm to produce another predetermined answer. The first person to arrive at the predetermined answer is declared the winner. The game described by McNeight is designed for play to large audiences by means of radio or television broadcast.

Although these games provide entertainment, they do not use any type of identified thinking skills in their play. Further, these games require that the players be knowledgeable with various types of well-known words or phrases in order to play the game.

SUMMARY OF THE PRESENT INVENTION

It is the object of the present invention to have a game which is played for home entertainment purposes. It is also an object of the invention to teach the application of identified thinking skills, and therefore, the game is also applicable to the educational environment. The game can also be used as a knowledge based teaching tool. Specifically, the game is played with one person who controls the play of the game and several contestants who compete against each other to become the first to correctly guess a predetermined answer. The predetermined answer is associated with a series of clues, which are sequentially revealed to the contestants. During game play, the contestants are directed to apply identified cognitive skills to the revealed clues to correctly guess the predetermined answer.

In accordance with the game described above, a new method of playing a competitive home entertainment game is also disclosed.

DESCRIPTION OF THE PREFERRED EMBODIMENT

The invention consists of a game played for entertainment purposes in a home or similar environment or an educational setting. The game can be played with a minimum of three players, but is capable of being played by many more players. There is no maximum limit on the number of players. The game can be played in multiple rounds. In each round, one of the players serves as the person controlling the game, and the remaining players are the contestants who compete against each other to be the first to correctly guess the indicated answer. Alternatively, the remaining players could be grouped into teams with the game played competitively among the teams.

Figure 3:
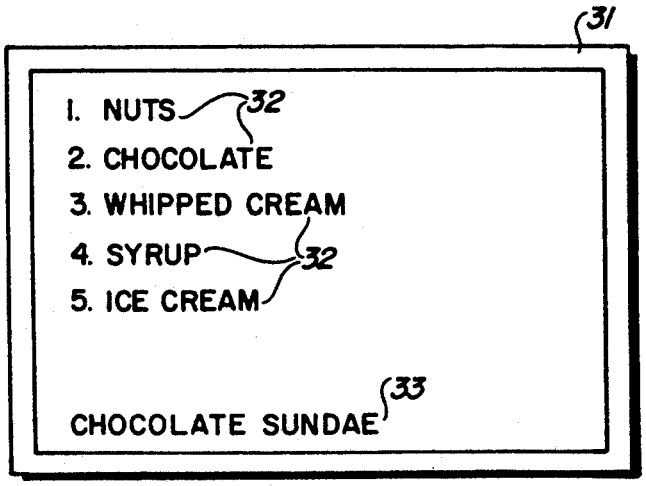
FIG. 3 is a sample of the game cards used to play the game in the preferred embodiment.

The elements necessary to play the game consist of the players and a supply of game cards. A sample of a game card is shown in FIG. 3 as 31. Each of the game cards has a listing of a series of clues 32. An answer 33 is associated with each series of clues, In the preferred embodiment of the game contains a wall chart 21 listing game control functions including the terms, "Stop", "Start", "Warmer", "Colder", "Different From, Change Course", "Take Your Time", and "Last Guess". The game also includes a wall chart 11 containing a list of cognitive skills denominated "Thinking Skills". The list of cognitive skills is further discussed below.

In other embodiments of the game, both wall chart 21 and wall chart 11 could have other forms, such as the list of game control functions. The list of cognitive skills could be written on a black board, shown on an overhead projector, displayed on a slide, or otherwise shown in a manner so that they can be seen by the contestants and easily referred to by the person controlling the play of the game. Other similar methods for displaying the game control functions and the cognitive skills will be readily apparent to those skilled in the art.

The game control functions are used to control the play of the game. The "Start" command is used to allow the contestant to begin guessing at the indicated answer. The commands "Warmer", "Colder", "Different From, Change Course" and "Last Guess" are used to direct the course of the guesses and to indicate to the contestants whether they are progressing toward the indicated answer. The "Stop" command is used to temporarily stop the contestants from guessing so that other commands can be given, such as the "Last Guess" command which the person controlling the play of the game uses to direct a contestant to repeat his last guess. The "Take Your Time" command is used to slow the pace of the game to allow the contestants to consider applying the cognitive skills directed by the person directing the play of the game.

Figure 1:
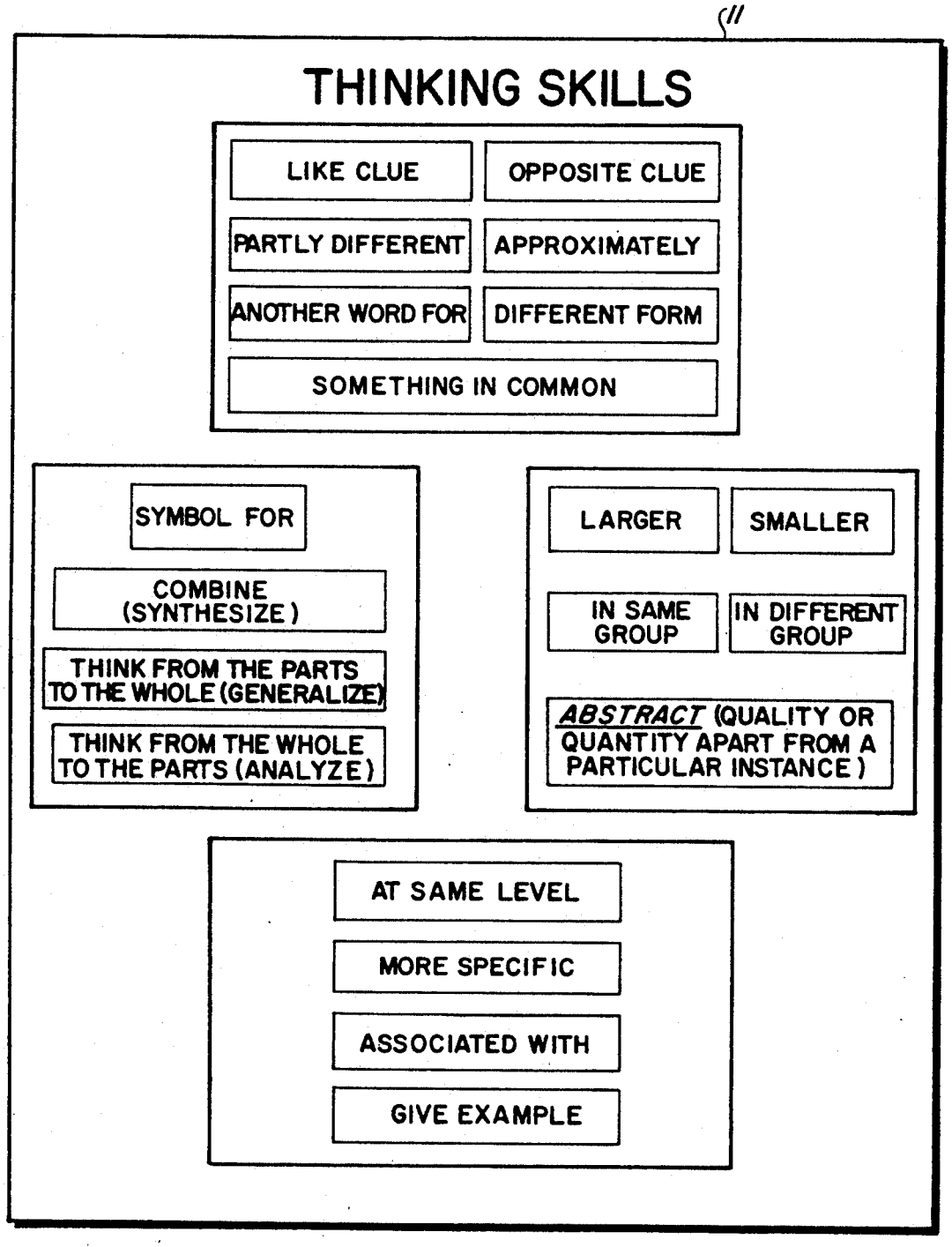
FIG. 1 is a sample of a chart of the cognitive skills used in the play of the preferred embodiment of the game denominated "Thinking Skills".
Figure 2:
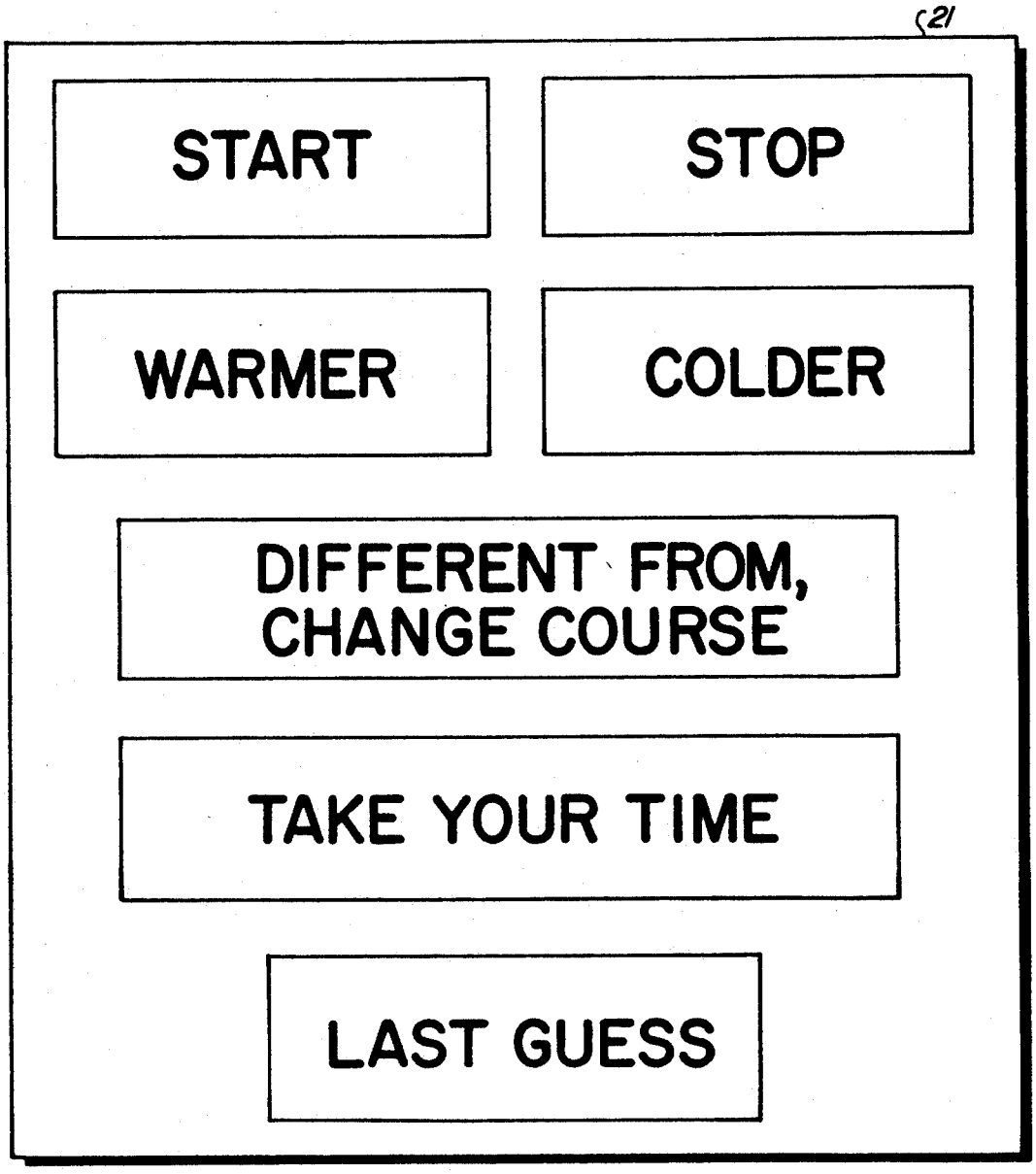
FIG. 2 is a sample of a chart of the game control functions 15 used in the play of the preferred embodiment of the game.

The game also contains a listing of certain cognitive skills, which, in the preferred embodiment, would be placed on a wall chart as shown in FIG. 1 as 11, labeled "Thinking Skills". These skills include: "Like Clue"; "Opposite Clue"; "Partly Different"; "Approximately"; "Another Word For"; "Different Form"; "Something In Common"; "Symbol For"; "Combine (Synthesize)"; "Think From The Parts To The Whole (Generalize)"; "Think From The Whole To The Parts (Analyze)"; "Larger"; "Smaller"; "In Same Group"; "In Different Group"; "Abstract (Express Quality or Quantity Apart From A Particular Instance)"; "At Same Level"; "More Specific"; "Associated With"; and "Give Example".

The cognitive skills referred to as "Thinking Skills" identified in wall chart 11, are used by the person directing the play of the game to direct the contestants to apply certain cognitive skills to the revealed clues to correctly guess the indicated answer. The cognitive skills "Like Clue", "Another Word For", "Different Form" and "Associated With" are used to direct the contestants to associate related concepts with the revealed clues.

The cognitive skill "Opposite Clue" is used to direct the contestants to associate opposing concepts to those specified in the revealed clues.

The cognitive skills "Partly Different", "Approximately" and "Something In Common" are used to direct the contestants to think of things that are similar in some aspects, but not identical to, the revealed clues, and to state that the indicated answer can be differentiated from the revealed clues.

The cognitive skill "Symbol" is used to indicate to the contestants that the clues are a symbol for the indicated answer, or the answer is a symbol of the revealed clues.

The cognitive skill "Combine (Synthesize)" is used to indicate that the clues need to be synthesized or joined together to be related to the answer.

The cognitive skills "Think From The Parts To The Whole (Generalize)" and "Think From The Whole To The Parts (Analyze)" are used to direct the contestants to generalize or analyze from the revealed clues.

The cognitive skills "Bigger" and "Smaller" are used to indicate the relative size between the revealed clues and the answer.

The cognitive skills "In The Same Group", "In Different Group" and "At The Same Level" are used to indicate whether the revealed clues can be grouped together with the indicated answer.

The cognitive skill "Abstract (Express a Quality or Quantity Apart from a Particular Instance)" directs the contestants to abstract from the revealed clues.

The cognitive skills "More Specific" and "Give Example" direct the contestants to give examples of the revealed clues.

At the beginning of play, one of the players is randomly chosen to be the game control person or moderator of the game for that round, referred to as the "Gamemaster". The moderator could be chosen by a flip of a coin, the roll of a die, or any other random method. The moderator chooses a clue card 31, and looks at the indicated answer 33, associated with the clues 32 in such a manner so that the clues and the answer would not be revealed to the other players. The moderator then inserts the clue card 31 in a folder, or covers it in a manner so that the clue card can be shown to the players with only one clue showing. When the first clue 32 is revealed to the other players, the moderator directs the contestants to apply the cognitive skills, which are identified on the wall chart 11, to direct the players toward the answer 33. The players then in rapid fire fashion attempt to guess the answer 33 based on the clue and the thinking skills identified. The moderator can assist the players by stating whether their clues are getting "Warmer", "Colder" or can direct them to change course by using the game control functions indicated on wall chart 21. When no more progress is being made toward the answer 33, the moderator would then reveal an additional clue 32 from the series and again advise the players of the relevant cognitive skills, indicated on wall chart 11, to apply to that clue to direct them toward the correct answer 33. The game proceeds in this manner until one of the players guesses the correct answer 33.

In one embodiment of the game, a series of five clues is available to the contestants. The first player to correctly guess the answer 33 is the winner of that round.

In the preferred embodiment, the winner of each round becomes the moderator or "Gamemaster" for the next round. If all of the clues are revealed without a winner, the moderator provides clues of his or her own choosing until a winner of that round is determined. In other embodiments, the series of clues could be longer or shorter.

An example of the progress of a game round of the game is the following: the current game moderator, referred to as the "Gamemaster", looks at the series of clues and the predetermined answer. For purposes of this example there are five clues, namely "Nuts, Chocolate, Whipped Cream, Syrup and Ice Cream". The "Gamemaster" looks at the answer, in this case "Chocolate Sundae". The "Gamemaster" then places the series of clues in a folder so that the first clue "Nuts" is visible above the top of the folder, but all the other clues remain hidden. The "Gamemaster" then shows the clue "Nuts" to the other players, and then points to the cognitive skills "Associated With", "Think From The Parts To The Whole" and "Like Clue" which are displayed on a wall chart 11 visible to all of the players. The "Gamemaster" then says "Start", which game control function is also displayed to the rest of the players on wall chart 21. The players start guessing attempted answers. These guesses may include terms like "Crazy" or "Weird", in which case the "Gamemaster" would indicate "Colder" and "Change Direction" from the game control functions. Further guesses may include terms like "Fruit Cake", in which case the "Gamemaster" indicates that the guesses were "Warmer". When the players seem to be out of guesses they request an additional clue. The "Gamemaster" then reveals the next clue in the series from behind the folder, in this case "Chocolate", and also indicates the cognitive skills "Combine" and "Associated With" and then says "Start". The players begin guessing again. The game continues in this manner with the "Gamemaster" indicating "Warmer" and "Colder" as appropriate and revealing additional clues and thinking skills as necessary. The first player to guess the correct answer, in this case "Chocolate Sundae", is the winner of the round and becomes the "Gamemaster" for the next round.

In one version of the game, a point system is used to determine the winner of the game. A recommended point system gives the player who wins each round 5 points for guessing the correct answer. The "Gamemaster" for that round also gets 5 points if the answer is guessed with only the first clue being revealed; four points if the answer is determined after the second clue is revealed; three points if the answer is determined after the third clue; two points if the answer is determined after the fourth clue, and one point if the answer is determined after the fifth clue. The winner of the game is the first player to reach an agreed point total. Alternatively, the winner could be the player who wins the most rounds. Other methods for determining the winner of the game based on other point systems are also possible.

I claim:

1. A game played by two or more contestants and one person who controls the play of the game including:

a card which includes an indicated answer which is kept secret from the contestants, the identity of which each contestant attempts to be the first to guess correctly;

said card further including a plurality of clues which are sequentially revealed to the contestants, said plurality of clues is associated with the indicated answer; and means for indicating a plurality of cognitive skills; and director means for directing the contestants to apply indicated cognitive skills from the indicated plurality of cognitive skills to the revealed clues to correctly guess the answer.

2. The game of claim 1 further comprises means for indicating game control functions, said game control functions comprising starting the game, stopping the game, revealing the series of clues one clue at a time, directing the guessing by indicating whether the contestants' guesses are approaching the indicated answer, and controlling the pace of the game directed by the person controlling the game.

3. The game of claim 1 where said means for indicating a plurality of cognitive skills further includes a means for indicating the following cognitive skills: associating similar clues, associating opposite clues, partially differentiating clues, abstracting from clues, partially associating clues, identifying similar features of clues, synthesizing, generalizing, analyzing, grouping clues, and deduction.

4. The game of claim 2 further comprising a scoring means, said scoring means determining the winner of the game.

5. The game of claim 4 wherein said scoring means further includes a means for assigning a score to the winner of a round and a score to the person controlling the play of the game based upon the number of clues revealed when the answer is correctly guessed by a contestant, said scoring means determining the winner of the game.

6. A method of playing a game of the type having at least two contestants and a person who directs the play of the game, including the steps of:

providing a plurality of cards, each card containing a series of clues and an answer associated with the series of clues, from which the game director selects a card and reveals to the contestants at least one clue while not revealing the answer on the card;

providing display means for displaying a plurality of cognitive skills from which the director selects a cognitive skill;

indicating on said display means the selected cognitive skill to be used by the contestants in using the revealed clues to guess the answer.

7. The method of claim 6, further comprising the steps of playing a plurality of rounds of the game and identifying one of the at least two contestants as the winner of each round, wherein the contestant who wins the most rounds wins the game.

8. The method of claim 7 further comprising the step of appointing the winner of each round as the game director for the following round.

9. The method of claim 6 wherein the step of having the game director specify cognitive skills further comprises the sep of having the game director direct the contestants to apply at least one of associating similar clues, associating opposite clues, partially differentiating clues, abstracting from clues, partially associating clues, identifying similar features of clues, synthesizing, generalizing, analyzing, grouping clues, abstraction, and deduction.

10. The method of claim 6 further comprising determining the winner of the game based upon a predetermined point system.

11. The method of claim 10 further comprising the step of assigning points to the winner of each round and assigning points to the game director of each round based on the number of clues revealed when the answer is correctly guessed and identifying the winner of the game as the person with the greatest number of points at the end of the game.

12. A game including:

two or more contestants;

a card containing a plurality of clues which are sequentially revealed to said contestants;

said card further containing an answer which answer is associated with said plurality of clues and which answer is kept concealed from said contestants;

means for displaying a listing of cognitive skills; and director means for directing the play of the game by directing the contestants to apply cognitive skills from the displayed listing of cognitive skills to the revealed clues to correctly guess the answer.

13. The game of claim 12 further including a scoring means, said scoring means determining the winner of the game.

* * * * *